United States Patent [19]

Imaizumi et al.

[11] Patent Number: 4,634,262

[45] Date of Patent: Jan. 6, 1987

[54] TONER IMAGE FIXING CONTROL PROCESS AND APPARATUS IN ELECTROSTATIC COPYING MACHINE

[75] Inventors: Masaru Imaizumi, Shinshiro; Masazumi Ito, Toyokawa; Kenji Shibazaki, Aichi, all of Japan

[73] Assignee: Minolta Camera Kabushiki Kaisha, Osaka, Japan

[21] Appl. No.: 759,497

[22] Filed: Jul. 26, 1985

Related U.S. Application Data

[63] Continuation of Ser. No. 494,211, May 13, 1983, abandoned, which is a continuation-in-part of Ser. No. 189,246, Sep. 22, 1980, abandoned.

[30] Foreign Application Priority Data

Sep. 26, 1979 [JP] Japan ..... 54-124308

[51] Int. Cl.[4] ..... G03G 15/20; G03G 21/00

[52] U.S. Cl. ..... 355/14 R; 355/14 FU

[58] Field of Search ..... 355/3 R, 3 FU, 14 R, 355/14 FU; 219/216

[56] References Cited

U.S. PATENT DOCUMENTS

| | | | |
|---|---|---|---|
| 3,053,962 | 9/1962 | Cerasani et al. | 355/3 FU X |
| 3,588,445 | 6/1971 | Hopkins | 219/216 X |
| 3,745,304 | 7/1973 | Hutner | 219/216 |
| 3,878,358 | 4/1975 | Barton et al. | 355/3 FU X |
| 3,926,519 | 12/1975 | Rebres | 355/14 FU |
| 4,006,985 | 2/1977 | Hutner | 355/14 FU |
| 4,373,801 | 2/1983 | Itoh | 355/14 FU |

FOREIGN PATENT DOCUMENTS

| | | | |
|---|---|---|---|
| 52-38938 | 2/1977 | Japan | 355/3 FU |

*Primary Examiner*—Fred L. Braun

*Attorney, Agent, or Firm*—Wolder, Gross & Yavner

[57] ABSTRACT

The copying rate of an electrophotographic copying machine of constant paper advance speed including a toner image fixing unit which is selectively preset to predetermined values in increment inverse relationship to the thickness of the copy sheets employed, so that copy sheets of greater thickness are fed to the fixing unit for lesser feed rate than the thinner standard sheets, whereby the copy sheets are adequately heated at the different thicknesses. Following the termination of a copy sequence of thicker sheets at reduced feed rate, the copy machine automatically reverts to its rate setting for standard thickness sheets. In copying with standard thickness sheets, the period of the first copying cycle is greater than that for subsequent sheets and the copying rate with the thicker sheets is the same as that for the first copy with standard thickness sheets. A microcomputer network with a rate selector switch programs the copying machine in the above manner.

8 Claims, 8 Drawing Figures

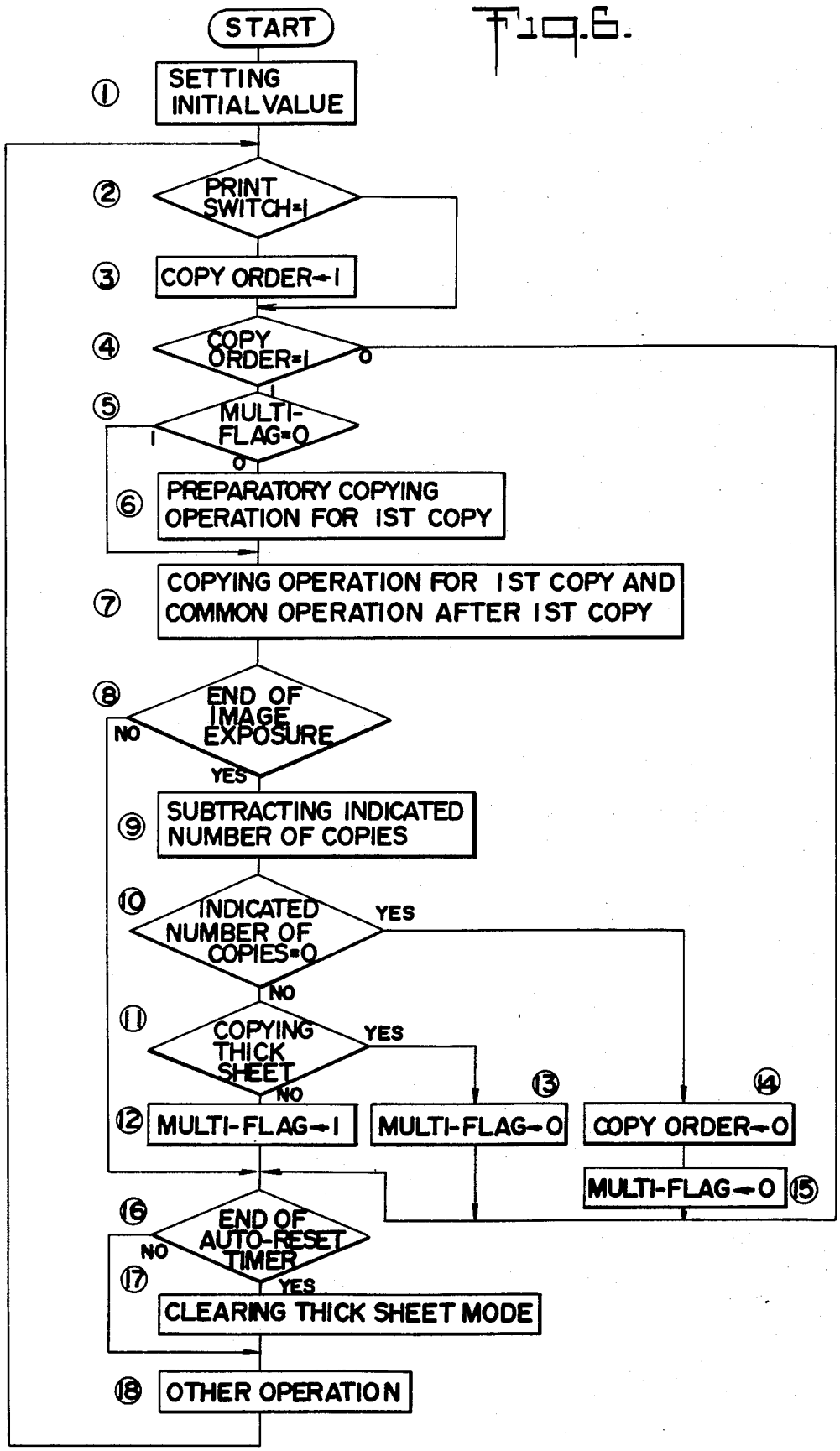
Fig.6.
START
① SETTING INITIAL VALUE
② PRINT SWITCH=1
③ COPY ORDER←1
④ COPY ORDER=1
0
1
⑤ MULTI-FLAG=0
1
0
⑥ PREPARATORY COPYING OPERATION FOR 1ST COPY
⑦ COPYING OPERATION FOR 1ST COPY AND COMMON OPERATION AFTER 1ST COPY
⑧ END OF IMAGE EXPOSURE
NO
YES
⑨ SUBTRACTING INDICATED NUMBER OF COPIES
⑩ INDICATED NUMBER OF COPIES=0
YES
NO
⑪ COPYING THICK SHEET
YES
NO
⑫ MULTI-FLAG←1
⑬ MULTI-FLAG←0
⑭ COPY ORDER←0
MULTI-FLAG←0 ⑮
⑯ END OF AUTO-RESET TIMER
NO
YES
⑰ CLEARING THICK SHEET MODE
⑱ OTHER OPERATION

TONER IMAGE FIXING CONTROL PROCESS AND APPARATUS IN ELECTROSTATIC COPYING MACHINE

REFERENCE TO RELATED APPLICATION

This application is a continuation of application Ser. No. 494,211, filed May 13, 1983, now abandoned which is a continuation-in-part of U.S. patent application Ser. No. 06/189,246 filed Sept. 22, 1980, now abandoned.

BACKGROUND OF THE INVENTION

The present invention relates generally to improvements in the control of the operation of an electrostatic copying machine and it relates particularly to an improved method and apparatus for fixing toner images in accordance with the thickness of the copy paper which is fed to a fuser at constant paper feeding speed.

Sheets of copy paper employed in conventional electrostatic copying machines are generally limited to a narrow range of thicknesses (weights), for example, to the range of about 50 to 85 g/m$^2$. The conventional office paper is included in this range. In recent years, however, there has been a demand for electrostatic copying machines which can be used with thicker papers weighting 100 to 160 g/m$^2$, such as postal cards, labels, offset master sheets, etc., and such machines have become commercially available. The use of thick paper poses problems in the fixing of the copy as well as in the path of transport of the copy paper and in the image transfer station. In thermally fixing toner to a copy sheet for the development of a latent image, it is necessary to fuse the toner and heat the copy sheet to some extent at the same time. Accordingly, when the toner is to be fixed to the same degree on a copy sheet of conventional thickness and on a thicker copy sheet of different heat capacity, the latter requires a larger amount of heat in accordance with the difference in thickness. To meet this requirement, it has heretofore been a practice to set the fixing unit at a higher temperature only when using copy sheets of greater thickness, or to set the unit to a constant temperature at which the toner images can be fixed to thick sheets. With such a method, however, the fixing unit is not satisfactorily operable for thick copy sheets unless the unit has a heater of increased power capacity to compensate for a reduction in the temperature of the unit when continuously producing a plurality of copies. Especially in the case of copying machines adapted for a relatively short copy processing time wherein the copy processing time means the period of time consumed in processing each copy during a copying operation, for example, of about 20 to 30 copies per minute, it is almost practically impossible to restrict the overall power consumption to the limit of the conventional household power supply (100 V, 15A in Japan; 115 V, 15A in U.S.). Additionally, the latter of the two methods mentioned above is uneconomical since the fixing unit, when operating for copy sheets of conventional thickness, consumes a larger quantity of heat than is needed. On the other hand, a copying machine has been proposed which is so controlled that the copy processing time is reduced in accordance with a reduction in the temperature of the fixing unit to maintain the unit at least at a temperature below which improper fixing will result (Japanese Laid Open Patent Application Tokkaisho No. 54-80135). Another copying machine has also been proposed in which a copying start instruction is given only when the detected temperature of the fixing unit is no lower than a reference temperature to permit no copying operation at temperatures that would cause improper fixing (Japanese Laid Open Patent Application Tokkaisho No. 54-109446). With these machines, however, the variations in the temperature of the fixing unit, namely, the drop and recovery of the temperature are allowed to spontaneously occur and influence the copying processing time interval, producing varying copy processing times. When such machine is featured by a short copying processing time, the performance of the machine is still unsatisfactory in that the copying operation requires indefinite varying times.

SUMMARY OF THE INVENTION

It is a principal object of the present invention to provide in an electrostatic copying machine an improved process and system by which toner images are optimumly fixed at a copying processing time predetermined in accordance with the thickness of the copy paper which is fed to a fuser at constant paper feeding speed, employed without necessitating increased power consumption and with overcoming the aforesaid disadvantages and drawbacks heretofore experienced.

Another object of the present invention is to provide an improved process and system characterized by their reliability, efficiency and high adaptability and versatility.

The present invention contemplates the provision in an electrostatic copying machine a toner fusion operation control process and system characterized in that at least when a plurality of copies are to be made with the use of copy sheets of varying thicknesses which are fed to a fuser at a constant speed, the interval or period of time for processing each copy during at least a continuous copying operation is set in respectively different modes in accordance with the thickness of the processed copy sheets, to process a sheet for a preset period of time longer than that for another sheet thinner than said sheet.

Advantageously the different modes include a first copy processing mode having a predetermined processing time and a multi-copy processing mode having shorter processing times than the first copy processing mode, the continuous copying operation of the standard sheet proceeding in accordance with said multi-copy processing mode, the continuous copying operation of thick sheets proceeding in accordance with the first copy processing mode and a first copying operation of the standard sheet and the thick sheet being effected by the first copy processing mode.

BRIEF DESCRIPTION OF THE DRAWINGS

FIG. 6 is a flow chart of an embodiment of the improved system, and

DESCRIPTION OF THE PREFERRED EMBODIMENT

Figure 1:
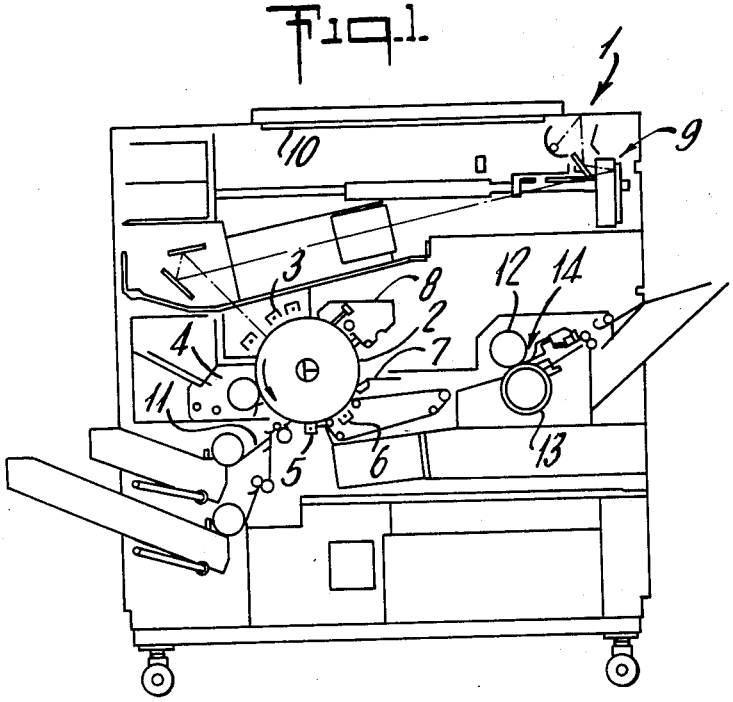
FIG. 1 is a diagrammatic sectional view showing a copying machine to which the present invention is applied.

Illustrated in FIG. 1 is an electrophotographic copying machine to which the present invention is applied and which includes a photoconductive drum 2 rotatably mounted in a suitable portion of the main housing of copying machine 1. Arranged around the drum 2 in the known manner and of known construction are a sensitizing charger 3, a toner developing unit 4, a transfer charger 5, a separating charger 6, a separating pawl, a cleaning unit 8, etc. When the drum 2 is driven in a counterclockwise direction, the sensitizing charger 3 charges the surface of the drum, which is exposed to the image of an original (not shown) placed on a glass plate 10 and scanned by an optical system 9 and projected onto drum 2. The latent electrostatic image formed on the drum surface is converted by the developing unit 4 to a toner image, which is then transferred by the transfer charger 5 onto a paper copy sheet 11 fed to the drum in timed relation with its rotation. The copy sheet 11 bearing the toner image is separated from the drum surface by the charger 6 and pawl 7 and fed to a fixing unit 14 comprising a heat roller 12 and a press roller 13. The image is fixed by the heat roller 12, and the copying sheet is discharged from the machine 1. With the drum 2 in continued rotation after the transfer of the image, the cleaning unit 8 removes the residual toner from the drum in preparation for the following copying cycle.

Figure 2:
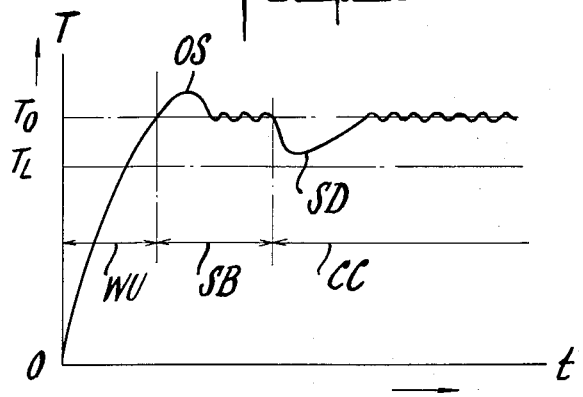
FIG. 2 is a graph showing the variations in the temperature of a toner image fixing unit when standard weight of thickness paper is used.

As shown in FIG. 2 which illustrates variations in the surface temperature of the heat roller 12 of the fixing unit 14, after warm-up WU, the temperature overshoots as at OS and then settles at a set value TO. After a standby period SB, the machine is initiated onto a continuous operation CC for producing copies and as a consequence the temperature of the roller 12 abruptly drops as at SD. At the same time, the heater is energized to gradully again raise the temperature since the amount of heat produced by the heater is greater than that absorbed by the copy paper 11. Indicated at TL is the lowest temperature of the heat roller 12 at which the toner can be properly fixed, and this temperature is dependent on the copy paper feeding speed, the type of the toner used, the kind of the copy paper and other parameters. To assure the proper fixing of the toner for making copies continuously at the temperature TO, the power consumption of the heater, and the other parameters must be so determined that the temperature resulting from the abrupt drop SD will not be lower than the temperature TL.

Suppose the value TO, power consumption, etc. are set for a standard thickness copy paper, if copy paper of a different thickness, particularly copy paper of greater thickness and higher heat capacity than the standard paper, is then used in a continuous copying operation, the amount of heat removed by the paper increases to result in an improper or inadequate fixing of the toner.

Figure 3:
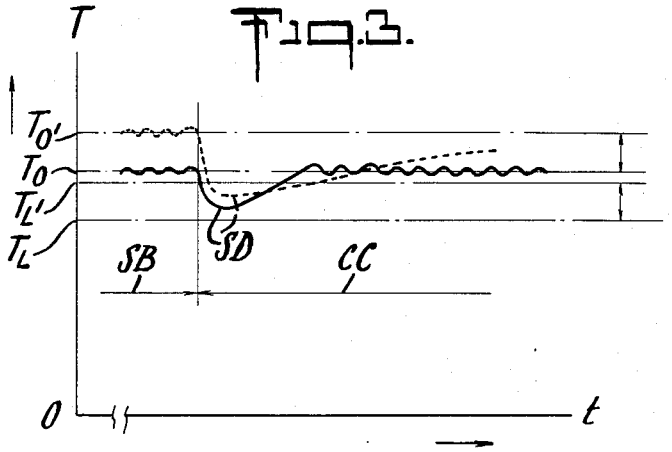
FIG. 3 is a graph showing variations in the temperature of the toner image fixing unit when thick paper is used.

FIG. 3 shows the variations in the temperature of the heat roller 12 when thick copy paper is used for a continuous copying operation. The solid-line curve represents the temperature variations for the standard copy paper (about 50 to 85 g/m$^2$). TO and TL are the same as those shown in FIG. 2. The dotted curve represents the temperature variations for the thick paper (about 100 to 160 g/m$^2$). Since the lowest temperature TL′ permitting the proper fixing of the toner for the thick paper is higher than TL for the standard paper by $\alpha$, the set temperature TO′ is TO$+\alpha$.

However, when the machine is brought into a continuous operation with the use of the thick paper, the amount of heat absorbed or removed by each sheet is larger than is the case with the standard paper. Consequently there is a sharper temperature drop, as at SD, than in the latter case to a level which is lower than TL′. Moreover, recovery to the temperature setting TO′ takes a longer period of time. This condition may be avoided by increasing the power consumption of the heater, or by setting TO′ at a higher level, but in the former case, the conventional household power supply has great difficulty in affording the power needed for the overall copying machine. In the latter case (which poses a serious problem especially when the fixing unit includes a heat roller), it is difficult to elevate the temperature setting TO′ to a very high level in view of the low heat conductivity of the heat roller 12 because of the non-adhesive coating (as of silicone rubber, Teflon, or the like) on the surface of the roller 12 is heatresistant at temperatures of up to about 210° to 260° C.

Figure 4:
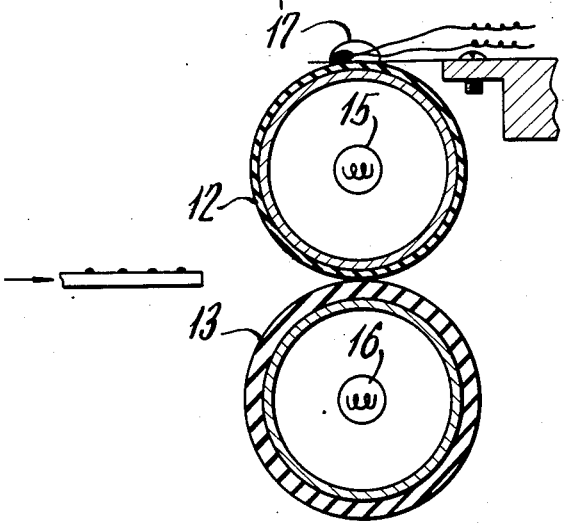
FIG. 4 is a sectional view showing a toner image fixing unit to which the present invention is applied.

In view of the aforesaid limiting factors, the following experiment was conducted using a copying machine operable at a copy processing time of 30 copies/min. (A4 size). With standard paper (80 g/m$^2$), 200 copies were continuously produced at a copy processing time of 30 copies/min. at a temperature setting of 165° C. (the lowest temperature for proper fixing being 160° C.). With thick paper (152 g/m$^2$), 100 copies were continuously produced at each of the copy processing times of 30 copies/min., 18.5 copies/min. and 12 copies/min. at a temperature setting of 180° C. (the lowest temperature for proper fixing being 175° C.). The standard paper copies and the thick paper copies obtained were checked for toner fixing performance, the latter at the varying copy processing times. As shown in detail in FIG. 4, the fixing unit 14 used comprises a press roller 13 which is of the internally heated type in view of the heat resistance of the heat roller surface. The fixing unit 14 comprises:

Heat roller 12 which is 67 mm outside diameter and includes an aluminum pipe of 2 mm wall thickness having a 0.6-mm-thick RTV silicone rubber coating over the outer surface thereof and provided with a 100-V, 700-W upper heater lamp 15 in its interior;

Press roller 13 which is of 73 mm outside diameter and includes an aluminum pipe of 2 mm wall thickness and having a 3.5-mm-thick RTV silicone rubber coating over the outer surface thereof and provided with a 100-V, 400-W lower heat lamp 16 which is de-energized only while the exposure lamp is on; and Temperature control thermistor 17 in contact with the surface of the heat roller 12 for the ON-OFF control of the upper heater lamp 15 by means of a suitable control network.

The results of the experiment are listed in Table 1 on the next page. Note: Repeated ON-OFF of the heater indicates that the heater has restored the temperature set before the start of the continuous operation.

TABLE 1

| | | | | |
|---|---|---|---|---|
| Copy Item Paper | 80 g/m$^2$ | 152 g/m$^2$ | 152 g/m$^2$ | 152 g/m$^2$ |
| Lowest fixable temperature | 160° C. | 175° C. | 175° C. | 175° C. |
| Temperature Setting | 165° C. | 180° C. | 180° C. | 180° C. |
| Copy processing time | 30 copies/min. | 30 copies/min. | 18.5 copies/min. | 12 copies/min. |
| Number of copies | 200 | 100 | 100 | 100 |
| Fixing performance | All 200 copies with fixed toner images | Faults in fixed images on 15th and following copies | All 100 copies with fixed images | All 100 copies with fixed images |
| Energization of heater | Continuously ON for 1st to 90th copies followed by repeated ON-OFF | Continuously ON for all 100 copies | Continuously ON for 1st to 60th copies, followed by repeated ON-OFF | Continuously ON for 1st to 35th copies, followed by repeated ON-OFF |

The experiment results listed in Table 1 demonstrate that in the case of the thick paper, a great reduction in the temperature causes improper fixing despite the rise of the temperature setting and that insufficient power consumption of the heater delays the recovery of the temperature. It is also seen that at the same sheet feeding speed and at the same temperature setting with the same power consumption for the heater, an increase in the copy processing time interval, has some freedom for fixing the toner on copy paper.

Thus it is useful to set the fixing unit at a higher temperature and increase the copy processing time interval for fixing the toner to thick paper which requires a larger amount of heat than the standard paper. However, if the copying machine has some freedom in its overall power consumption with no problem encountered in the durability of the fixing unit, there is no need to set the fixing unit to different temperatures for the standard paper and the thick paper, but the machine may be set at the same predetermined temperature for both the papers at which temperature the toner can be fixed also to the thick paper at a predetermined copy processing time interval, such that only the copy processing time interval for the standard paper is changed to the predetermined copy processing time interval for producing copies on the thick paper.

According to the present invention which is based on the above findings, copy sheets are fed to a fuser at the same sheet feeding speed and the same fuser temperature, the copy processing time interval (namely the period of time consumed in processing each copy during a continuous copying operation) is set in different modes for copy sheets of different thicknesses in accordance with the thickness of the sheet to process thick sheets for a longer period of copy processing time interval than the standard sheets so that the toner is fixed to the thick sheets at a constant copy processing time interval established by the specified processing time. However, the copy processing time interval need not be set at many divided levels in strict accordance with the varying thicknesses of copy sheets since good results can be achieved when the copy processing time interval is set at two different values for the standard paper and the thick paper respectively or at three different values for three kinds of papers including another paper of intermediate thickness.

Although the invention has been described above as applied to a fixing unit of the heat roller type, the invention is similarly useful for other heat fixing systems from the viewpoint of the transfer of heat from the fixing unit to the copy paper.

There is hereinafter described an example of the present invention in which the copy processing time is set in accordance with the specific processing modes of the copying machine in relation to the thicknesses of copy papers.

Generally with copying machines operable at a short copy processing time of about 20 to 30 copies/min., the copy processing time for the first copy is longer than for each of the second and following copies when making a multiplicity of copies due to the times required for the warm-up of the motor as well as of the exposure lamp, the erasing procedure for the photoconductive member, etc. While sheets of the standard paper are processed in the usual mode, sheets of thick paper are processed in a mode which utilized the difference in processing time between the first copy and the following copies of the standard paper mentioned above and in which the copying operation for the first copy of the standard paper is repeated for each thick copy instead of resorting to the multi-copy operation conducted for the second and subsequent copies of the standard paper. With this mode set for processing a multiplicity of thick copies, the number of copies made per unit time is reduced to provide the additional copy processing time for fixing the toner to the thick paper.

Figure 7:
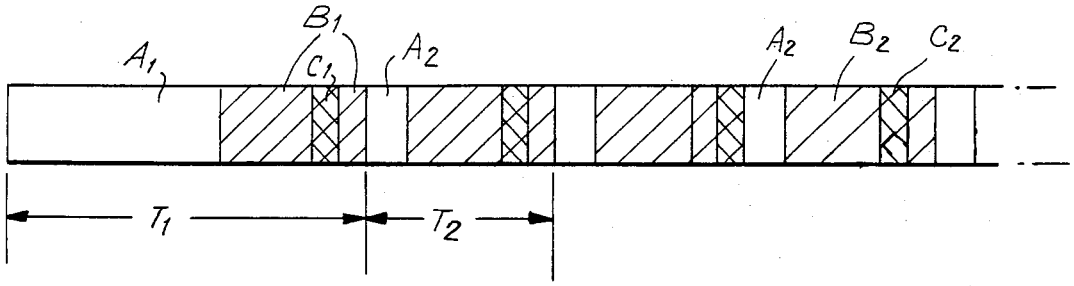
FIGS. 7 and 8 are diagrams of the timing sequences of the copying machine thin and thick paper copying modes respectively.
Figure 8:
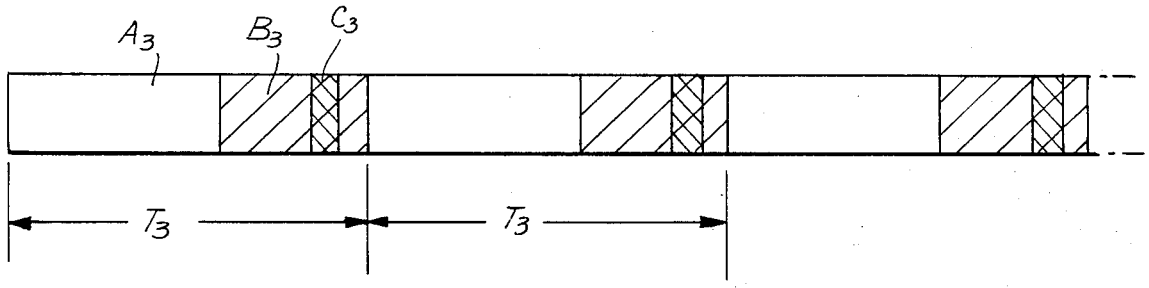

Thus, as shown in FIG. 7 in the standard paper multi-copy processing mode the processing time $T_1$ for the first copy is relatively long, for example, a rate of 18 copies/min., and each interval includes a standby or dormant period $A_1$, a period $B_1$ during which a paper sheet is advanced and processed, during which period the toner carrying sheet is exposed for a period $C_1$ to the fuser. The subsequent copies in thin paper each have a shorter processing time $T_2$, for example, 30 copies per minute, each including a dormant period $A_2$ less than $A_1$, paper advancing and processing period $B_2$ and fuser exposure period $C_2$ which are equal in duration to periods $B_1$ and $B_2$ respectively. As seen in FIG. 8 which illustrates the timing sequence for the thick paper multi-processing mode, each of successive processing time $T_3$ is equal to the others and is equal to processing time $T_1$, that is 18 copies/min. and each includes dormant period $A_3$, paper advancing and processing period $B_3$ and fuser exposure period $C_3$ equal to periods $A_1$, $B_1$ and $C_1$ respectively. It should be noted that periods $B_1$, $B_2$ and $B_3$ are equal and constant as are fuser exposure periods $C_1$, $C_2$ and $C_3$, while hold up periods $A_1$ and $A_3$ are greater than periods $A_2$. The speeds of advance of the copy sheets are equal and constant.

When the copying machine is allowed to stand for a period of time (set by an autoreset timer) namely when no key input is given for a copying operation during such time period, the machine is automatically brought out of the thick copy processing mode and is set for the standard copy processing mode so as to avoid the following drawbacks. When the machine is allowed to stand in the former mode, power will be wasted. Since copies will be made much less frequently with thick sheets, it is likely that the next user will start the machine without noticing that it is set for thick sheets. High-temperature offset or like trouble would then occur.

Figure 5:
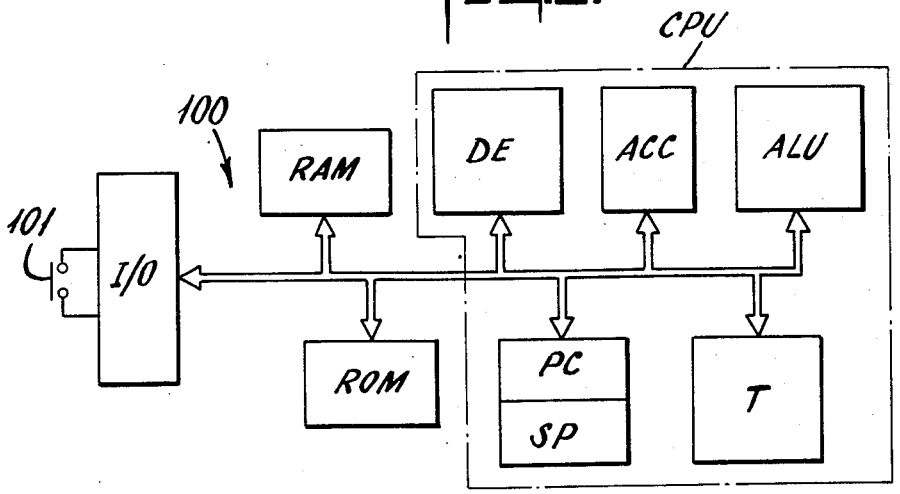
FIG. 5 is a block diagram of a microcomputer used in an embodiment of the present invention.

Referring to FIG. 5, a microcomputer designated by the reference numeral 100 is incorporated in the electrophotographic copying machine for controlling various operation sequences carried out at a number of stations and by various devices. The microcomputer 100 comprises a central processing unit CPU, a random access memory RAM and a read only memory ROM which are connected to an input and output interface I/O and are constructed by one or more chips of large scale integrated (LSI). The central processing unit CPU includes an arithmetic-logic unit ALU, an accumulator ACC, a decoder DE, a program counter PC, a stack point SP and a timer T.

The sequence control signal for each of the devices in the copying machine is generated in accordance with a program memorized in the read only memory ROM while a timing in which the read only memory ROM generates the sequence control signal is determined by the number of pulses counted in the counter. These pulses are produced by the timer T. Although the central processing unit CPU further includes flags F/F and a number of working registers, they are omitted from the drawings for the sake of brevity. A switch 101 connected to the interface I/O is provided on the control panel (not shown). The program of the computer 100 is set to the thick copy processing mode at "on" of switch 101, and is set to the standard copy processing mode at "off" of switch 101.

FIG. 6 illustrates the control process described above and the flow chart shown therein is hereinafter described. When the program on microcomputer 100 incorporated in the copying machine is started, an initial value is set at (1). It is assumed that the flag to be used subsequently is "0". At (2) judgment is made as to whether or not the print switch has been depressed. If it is not depressed, the flag for giving a copy order remains "0" at (3). If the print switch is on, the order turns to "1". At (4) judgment is made as to whether the copy order is "0" or "1". When the order is "0", the output from (4) is fed to (16). When it is "1", (5) judges whether the multiflag is "0" or "1". If the multiflag is "0", (6) performs the "preparation for making 1st copy only", and then (7) performs the "copying operation for 1st copy and common operation after 1st copy". If it is "1", the output form (5) is given to (7) which performs "copying operation for 1st copy and common operation after 1st copy" only.

The multiflag is a flag of such nature that it is "0" only for making the 1st copy and thick copies. At (8) judgment is made as to whether the photoconductive member has been completely exposed to the original image. When the exposure is judged as completed, (9) reduces the copy count. At (10) judgment is made as to whether the count has been reduced to "0", namely whether or not the number of copies set on the counter have been completed. If it is "0", "copying order" and "multiflag" are both changed to "0" at (14) and (15) respectively. When the count has not been reduced to the order of "0", namely if the machine is still in operation for making the specified number of copies, (11) judges whether or not the operation is for thick paper. In the case that it is not thick paper copying, the multiflag is set to "1" at (12). At (16) judgement is made as to whether or not the time set on the autoreset timer is up.

The autoreset timer, although not shown in the flow chart, is set on the completion of a copying operation or in response to a key input. Completion of operation of the autoreset timer means that the copying machine has been allowed to stand for the period of time set on the timer.

On completion of the timer operation, the machine is brought out of the thick copy processing mode into the standard copy processing mode at (17). Other necessary operations are conducted at (18), whereby one routine of the program is terminated. The program will be started again at (2). "Preparation for making 1st copy only" at (6) and "copying operation for 1st copy and common operation after 1st copy" at (7), although shown in separate blocks in the flow chart, are not completely separate operations, but the illustration means that timers are set at different values, for example, for setting the pre-energization time for the exposure lamp.

When the multiswitch is turned on upon setting the machine to produce a plurality of copies in the procedure of the flow chart described, the operation is started with "0" for the multiflag, which is processed at (6) to provide a copy processing time of 18.5 copies/min. On the other hand, if the multiflag is "1", the output is transmitted to (7) bypassing (6), affording a copy processing time of 30 copies/min. The first sheet of the standard paper is processed with the multiflag of "0" at the copy processing time of 18.5 copies/min. With completion of the first copy, the multiflag changes to "1" at (11), with the result that the second and following copies are processed at 30 copies/min. In the case of the thick paper the first copy is processed at 18.5 copies/min. with "0" for the multiflag. Since the multiflag is changed to "0" at (13) for the second and subsequent thick copies by "on" of the switch 101 on the control panel for specifying the thick paper, these following copies are processed at 18.5 copies/min.

With copying machines in which the copy processing time for the first sheet of standard paper is not longer than that for the second and following standard sheets (namely copy processing time for the first sheet $\leqq$ copy processing time for the second and following sheets) and which are unable to satisfactorily fix the toner to thick paper, the machine may be set in such a processing mode that the copy processing time for the thick paper is longer than for the standard paper when making a single copy and also when making a plurality of copies by a continuous operation.

With the system and process of the present invention, copy paper is processed for a predetermined period of copy processing time in accordance with the thickness of the paper so that the reduction in the temperature of the heat roller due to the absorption of heat by the paper in each copying cycle is fully remedied before the subsequent cycle. Consequently copies with satisfactorily fixed toner images are produced at a constant copy processing time interval even with use of copy paper of increased thickness at the same sheet feeding speed without the necessity of setting the heater to a particular higher temperature. The power needed for the overall copying machine is thus readily available from the limited domestic power supply and waste of heat is minimized to effect energy savings since copies are made at a predetermined fixed temperature setting at a preset copy processing time interval in accordance with the thickness of the paper used. The copying machine is highly convenient in that copies on paper of a particular thickness are made at a constant copy processing time interval in a definite period of time. Since copy sheets of different thicknesses are processed for different periods of copy processing time intervals set in individually different modes in accordance with the thickness of the processed sheet, the machine is easily controllable with the use of the copy cycle already set for the machine, as it is or with a modification. The present invention accordingly facilitates the modification of existing copying machines.

While there has been described and illustrated a preferred embodiment of the present invention, it is apparent that numerous alternations, omissions and additions may be made wthout departing from the spirit thereof.

What is claimed is:

1. A toner image fixing control process for an electrostatic copying machine in which the time interval of an individual sheet feeding cycle is variable characterized in that in the production of a plurality of copies with thick and thin copy sheets which are advanced through a toner image fixing station at a constant sheet advancing speed by copy sheet advancing means, said time interval of an individual sheet feeding cycle during a continuous copying operation is set at respectively different predetermined values between the thin and thick sheets by on-off control of a switch for specifying said thick copy sheet, to set a thick copy sheet feeding cycle for a pre-set period of time longer than that for said thin copy sheet, wherein said feeding cycle time interval includes a standby period and a sheet feeding period, said standby period of said thick sheet for each of the second and following copies being longer than that of said thin copy sheet and said sheet feeding periods being equal.

2. In the production by an electrostatic copy machine including a toner image fixing station through which thick copy and thin copy sheets are advanced at equal speeds and in which the machine has a variable cycle interval of the copy processing time, a toner image fixing control process comprising presetting the copy processing time of said copying machine to different predetermined cycle interval values by on-off control of a switch for specifying said thick copy sheet, wherein said individual copy processing cycle time interval includes a standby period and a sheet feeding period during which the copy sheet is fed for processing and said standby period of said thick copy sheet for each of the second and following copies during a continuous copying operation is longer than that of said thin copy sheet and said sheet feeding periods are equal and constant.

3. The process of claim 2, wherein said standby period of said thick copy sheet is equal to the standby period of said first copy of said thin copy sheet, and a standby period of said thick copy sheets are mutually equal.

4. In an electrostatic copying machine handling both thick copy sheets and thin copy sheets and including, a toner image fusing device;

means for advancing successive sheets of said thick and thin copy sheets at equal speeds through said fusing device;

a toner image fixing control circuit for selectively presetting the copying machine to different predetermined copying cycle time intervals by on-off control of a switch for specifying said thick copy sheet to increase the copying cycle time for the production of copies on said thick copy sheet, wherein said copying cycle time interval includes a standby period and a sheet feeding period during which the copy sheet is fed for processing, said standby period of said thick copy sheet for each of the second and following copies during a continuous copying operation being longer than that of said thin copy sheet and said sheet feeding periods are equal and constant.

5. In the production of copies by an electrostatic copying machine including, a toner image producing station and a toner image fusing station;

a toner image fixing control process comprising (1) successively advancing in a continuous sequence thick and thin copy sheets at a uniform and constant speed successively through said image producing and fusing stations by copy sheet advancing means, (2) regulating said fusing station to a constant predetermined temperature and (3) adjusting the feed rate of said sheets by on-off control of a switch for specifying said thick copy sheet, wherein the feed rate following the first sheet in said sequence is less for said thick copy sheet than for said thin copy sheet, the exposure time of said sheets in said fusing station is constant, said sheet feed rate is adjusted by varying the hold-up period between the feeding of successive sheets, the interval between the feeding of successive sheets includes a standby period and a sheet feeding period during which the copy sheet is fed for processing, and said standby period of said thick copy sheet for each of the second and following copies during a continuous copying operation is longer than that of said thin copy sheet and said sheet feeding periods are equal.

6. In an electrostatic copying machine handling both thin sheets and thick sheets, and including, means for producing a toner image on said sheet, a fixing unit for fixing the toner image onto said sheet, means for advancing said sheet through said toner image producing means and said fixing unit at a constant speed, and a toner image fixing control device comprising: a switch for selecting a thick sheet, a multiswitch for making a multiplicity of copies, and a control circuit for setting the copying operation of said copying machine to a thick sheet copy processing mode by activation of said thick sheet switch and to a standard sheet copy processing mode by disactivation of said thick sheet switch, and to a multicopy processing mode by activation of said multiswitch, said standard sheet copy processing mode having a specified cycle interval time for the first copy and a shorter cycle interval time than said specified cycle interval time for each of the second and following copies upon activation of said multiswitch, and said thick sheet copy processing mode having the same cycle interval time as said specified cycle interval time for the first copy, wherein each of said cycle interval times includes a standby period and a sheet feeding period, said standby period of said thick sheet during a continuous copying operation being longer than that of said thin sheet and said sheet feeding periods are equal and constant.

7. The copying machine of claim 6, wherein said fixing unit comprises a heat roller and a press roller, the surface temperature of said heat roller being set to a constant predetermined temperature and utilizes the difference in cycle interval times between the first copy and following copies of said standard sheet copy processing mode and is set to repeat the copying operation for said first copy of said thin sheet upon activation of said multiswitch.

8. The copying machine of claim 6 comprising automatic timing means for allowing the copying machine to stand for a period of time as set by said timing means, namely, when no key input is given for a copying operation during such time period, and for automatically bringing said machine out of the thick copy processing mode and setting it to the standard copy processing mode.

* * * * *